United States Patent [19]

Gronlund

[11] 4,010,951

[45] Mar. 8, 1977

[54] PORTABLE SUPPORT FRAME FOR A TENNIS NET

[76] Inventor: Thomas Richard Gronlund, 1835 Baldwin Drive, McLean, Va. 22101

[22] Filed: Nov. 25, 1975

[21] Appl. No.: 635,163

[52] U.S. Cl. ..... 273/29 BC; 273/29 B

[51] Int. Cl.[2] ..... A63B 69/00

[58] Field of Search ..... 273/29 BC, 29 BE, 29 B, 273/85 C; 29/7.1; 140/58; 256/26; 49/42, 50, 146; 119/15.5; D88/1; 135/4 R, 4 A, 4 B, 4 C, 7.1 R, 7.1 B; 272/5

[56] References Cited

UNITED STATES PATENTS

| | | | |
|---|---|---|---|
| 1,819,490 | 8/1931 | Weiss | 135/4 R |
| 2,159,309 | 5/1939 | Betourne | 135/4 R |

*Primary Examiner*—Richard C. Pinkham
*Assistant Examiner*—T. Brown
*Attorney, Agent, or Firm*—Finnegan, Henderson, Farabow & Garrett

[57] ABSTRACT

A portable support frame for a tennis net having a stable, horizontal base to the center of which is rigidly attached a vertical member for supporting the top center of a tennis net. Pivotally attached to and extending from each side of the base are beam support members the remote ends of which are attached to the top corners of the tennis net so that the tennis net is supported by two cantilever beams and the vertical support member all in the same vertical plane.

17 Claims, 6 Drawing Figures

PORTABLE SUPPORT FRAME FOR A TENNIS NET

FIELD OF THE INVENTION

This invention relates to portable frames for nets used in games and sports. Particularly, this invention provides a portable tennis net frame which correctly supports a regulation tennis net without any attachment to the surface on which the tennis net is being used.

DESCRIPTION OF THE PRIOR ART

The game of tennis requires a net of a certain height and a certain width. The net for a regulation singles tennis game is required to be 27 feet wide and the top of the net must be 3 feet above the ground at the center and 3½ feet above the ground at each end. These specific dimensional requirements and the substantial weight of the tennis net necessitate rigid support to provide the controlled tension necessary to meet the regulations. Generally, to provide the proper support for tennis nets the support means has had to be attached to the surface on which the tennis game is played.

The usual method of supporting a tennis net is to provide two posts embedded in the playing surface to which the net is attached. These posts have to be secure so that controlled tension can be applied to the net in order to achieve the 3 foot height in the center and 3½ foot height at the net ends. In cases where the posts are not securely embedded in the playing surface, previously guy wires have had to be provided to properly support the posts.

Because of the requirement of a more or less permanent location for the tennis net and support means, tennis has been a game limited to those who can afford a permanent court or have had available the use of a permanent court. The expense involved in obtaining the necessary court with permanent net supports in order to play tennis has been well out of proportion to the cost of the necessary equipment, i.e. net, ball and rackets, for the game. This has been particularly detrimental to sport programs in school systems and in less affluent neighborhoods.

Portable net frames are not unknown in the prior art, but these are generally for practice nets or for nets for games other than tennis which are not as heavy as tennis nets or which do not require the same controlled tension applied to the net. Examples of the latter type of nets are those for volley ball and badminton.

Some portable nets provide stability to the side posts by having large bases. However, due to the weight of the 27 foot, or 36 foot in the case of doubles, tennis net and the required tension to be placed on the net, the bases of portable tennis net supports would have to be so large as to preclude portability.

These restrictions on the portability of regulation tennis nets have effectively hindered the expansion of tennis as a game for all. With an effective portable net, tennis could be played in parking lots, school basketball courts, in school field houses and gyms and even in the street. Schools could have, for a reasonable price, numerous tennis courts which are also used for other sports or athletics. City recreation departments could have numerous tennis courts placed in parking lots on weekends, in city parks on the grass, or even in closed off streets. It is the present invention which can provide these opportunities.

SUMMARY OF THE INVENTION

In accordance with the invention, as embodied and broadly described herein, the portable support frame for a rectangular net comprises a stable, horizontally disposed base, means rigidly attached to and extending vertically from the base for supporting the top of the rectangular net substantially at its center, a pair of beam means extending from and pivotally attached to the base for supporting the outer top ends of the rectangular net, and means for attaching the outer, top ends of the rectangular net to the remote ends of the beam means, the pair of beam means forming cantilever beams when attached to the net, the cantilever beams and the vertical support means being substantially in the same vertical plane.

Also in accordance with the invention, the portable support frame is dimensioned for supporting a regulation tennis net.

It is preferred that the stable, horizontal base be formed of a pair of substantially equilateral triangles rigidly connected at their apexes such that the bases of the triangular frames are substantially parallel.

It is also preferred that the base be formed of two like, integral base frame members each formed of a center section, two side sections extending obliquely from the ends thereof and at substantially the same angle thereto, and a flange extending from the remote end of each side section and being substantially parallel to the center section, the base frame members being joined back to back at their center section forming the sides and joined apexes of the equilateral triangular frames; and a pair of axles mounted in and between two opposite flanges, the axles being substantially parallel to each other and the ends of the axles extending through the flanges forming the bases of the triangular frames.

Preferably, wheels are attached to each end of both axles.

It is preferred that each beam support member be pivotally attached to the center of a respective one of the axles for rotation in substantially the same vertical plane, that the vertical support member be rigidly attached to the center sections of the joined base frame members, and that a pair of sleeves encompass each of the axles, one on each side of the attached end of the beam support member between the beam support member and the flange. It is also preferred that the portable support frame include two pairs of sway restraint braces, the braces of each pair being attached at one end to a respective one of the beam support members, the other ends of each pair of sway restraint braces being pivotally attached for rotation in a vertical plane to the opposite ends of the respective axles between the sleeves and the flanges. It is advantageous for the beam support members to be comprised of two or more detachable sections.

It is also preferred that the portable support frame be made of a material sufficiently strong and rigid to provide the required support and tension for a regulation tennis net. It may be preferred that weights are attached to the remote ends of the beam support members.

This invention provides a support frame for a tennis net which is portable and does not require attachment to the playing surface.

The portable support frame of this invention provides a means for supporting a tennis net of regulation size at a regulation height above the ground.

The invention also provides a portable support frame for a tennis net which may be partially disassembled and folded for storage and ease of portability.

Additional objects and advantages of the invention will be set forth in part in the description which follows, and in part will be obvious from the description or may be learned by practice of the invention. The advantages of the invention may be realized and attained by means of the instrumentalities and combinations particularly pointed out in the appended claims.

The invention consists in the novel parts, constructions, arrangements, combinations and improvements shown and described. The accompanying drawings, which are incorporated in and constitute a part of the specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
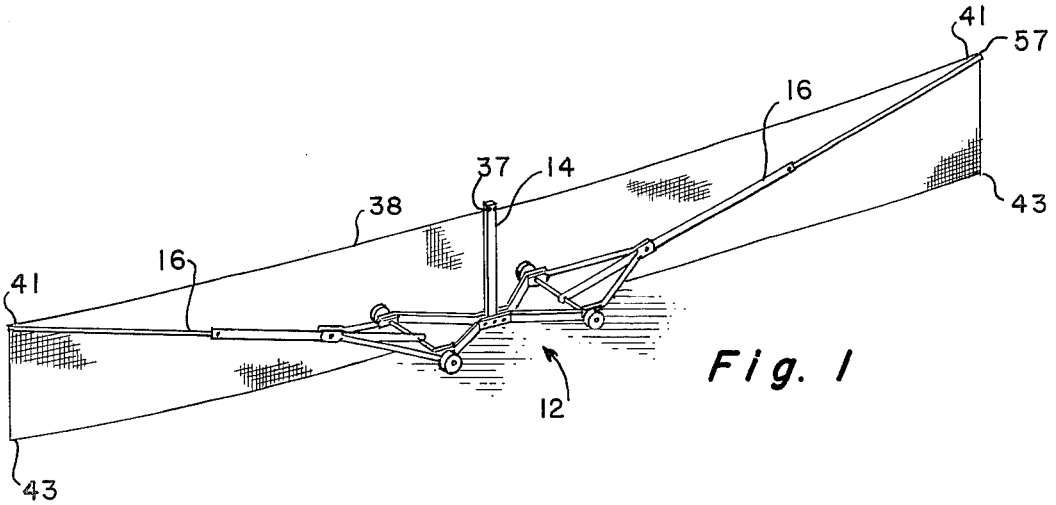
FIG. 1 is a perspective view of a portable support frame constructed in accordance with the teachings of the invention with a tennis net supported by the frame.

Referring now to FIG. 1, it may be seen that the portable support frame is useful for supporting a tennis net without the necessity of attachment to the playing surface. The portable support frame includes a base 12, a vertical support member 14 and a pair of beam support members 16.

Figure 2:
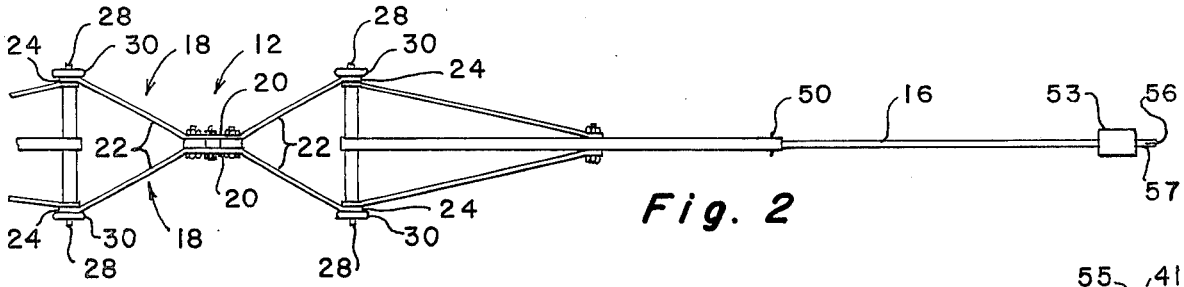
FIG. 2 is a top view of the base and one beam support member of the portable support frame of FIG. 1.
Figure 4:
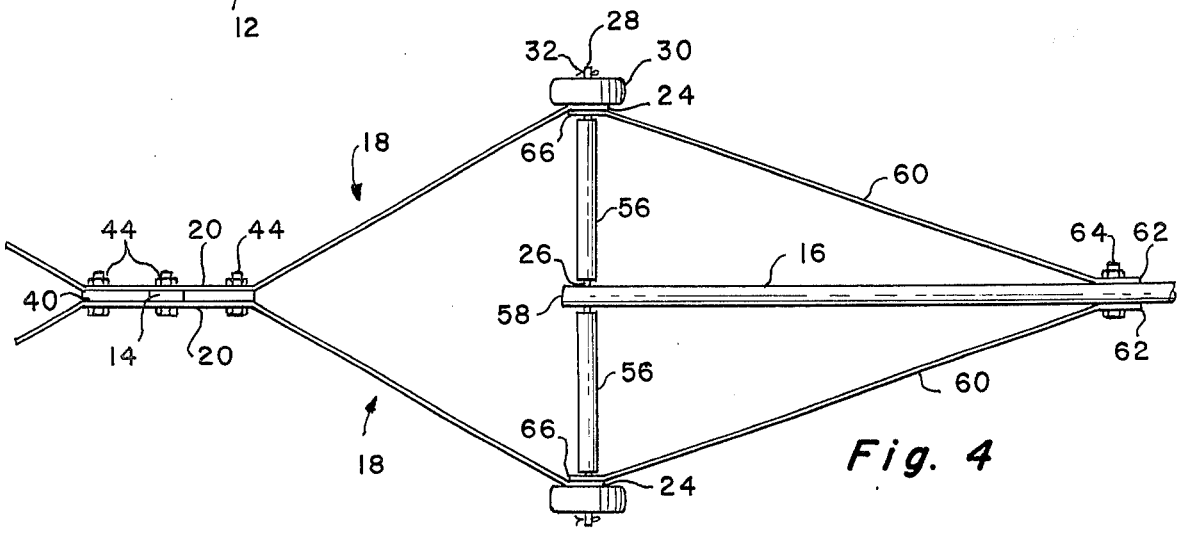
FIG. 4 is a magnified partial top view of the base and one beam support member of the portable support frame of FIG. 1.

In accordance with the invention, the base 12 is a stable, horizontally disposed base. While the base may be a rectangular frame or a pair of equilateral triangular frames joined at their apexes, as herein embodied and as best seen in FIG. 2, the base 12 is comprised of two like, integral base frame members 18 each formed of a center section 20, two side sections 22 extending obliquely from the ends of the center section 20 at substantially the same angle, and a flange 24 extending from the remote end of each side section 22 and substantially parallel to the center section 20. As best seen in FIG. 4, the base frame members 18 are joined back-to-back at their center sections 20. A pair of axles 26 are mounted in and between two opposite flanges 24 and are substantially parallel to each other. The ends 28 of the axles 26 extend through the flanges 24.

Preferably and as herein embodied, wheels 30 are rotatably attached to each end 28 of both axles 26 which extend through the flanges 24. The wheels 30 may be attached by any common method such as by means of a cotter key 32 as depicted in FIG. 4.

Figure 3:
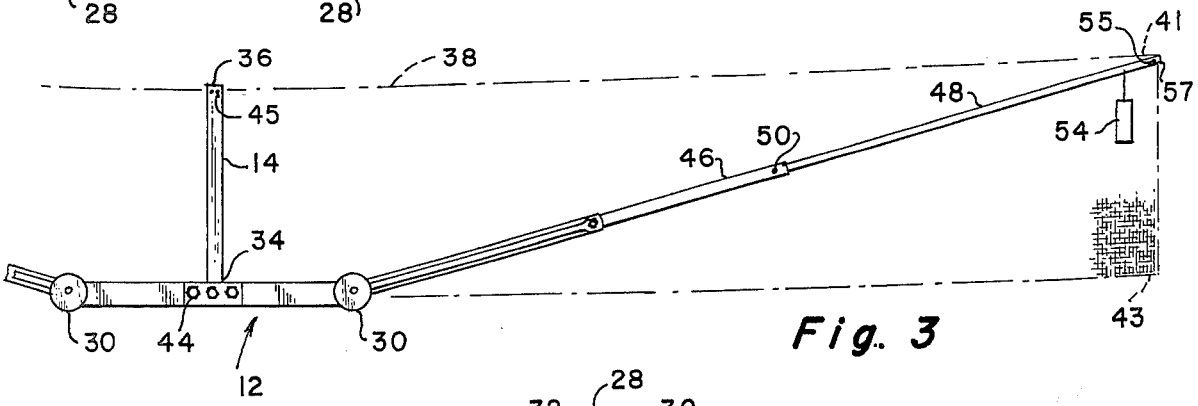
FIG. 3 is a side view of the portable support frame as depicted in FIG. 2.

In accordance with the invention, means rigidly attached to and extending vertically from the base is provided for supporting the top of a rectangular net, substantially at its center. As herein embodied and as best seen in FIG. 3, a vertical support member 14 is provided for supporting the top of a tennis net 38 substantially at is center. One end 34 of the vertical support member 14 is rigidly attached to the base 12 and the remote end 36 has means for attaching and supporting the top center of the tennis net 38. Any means may be provided to attach the top center of the tennis net 38 to the remote end 36 of the vertical support member 14. In FIG. 3, a pair of holes 45 are depicted through which the top supporting cable of the tennis net 38 may be passed, although other means may be used. For example, in FIG. 6, slots 39 are provided in the edges of the vertical support member 14 near its remote end 36 to support a line wound around the top 36 of the vertical support member 14 and tied to the top center of the tennis net 38.

Figures 5, 6:
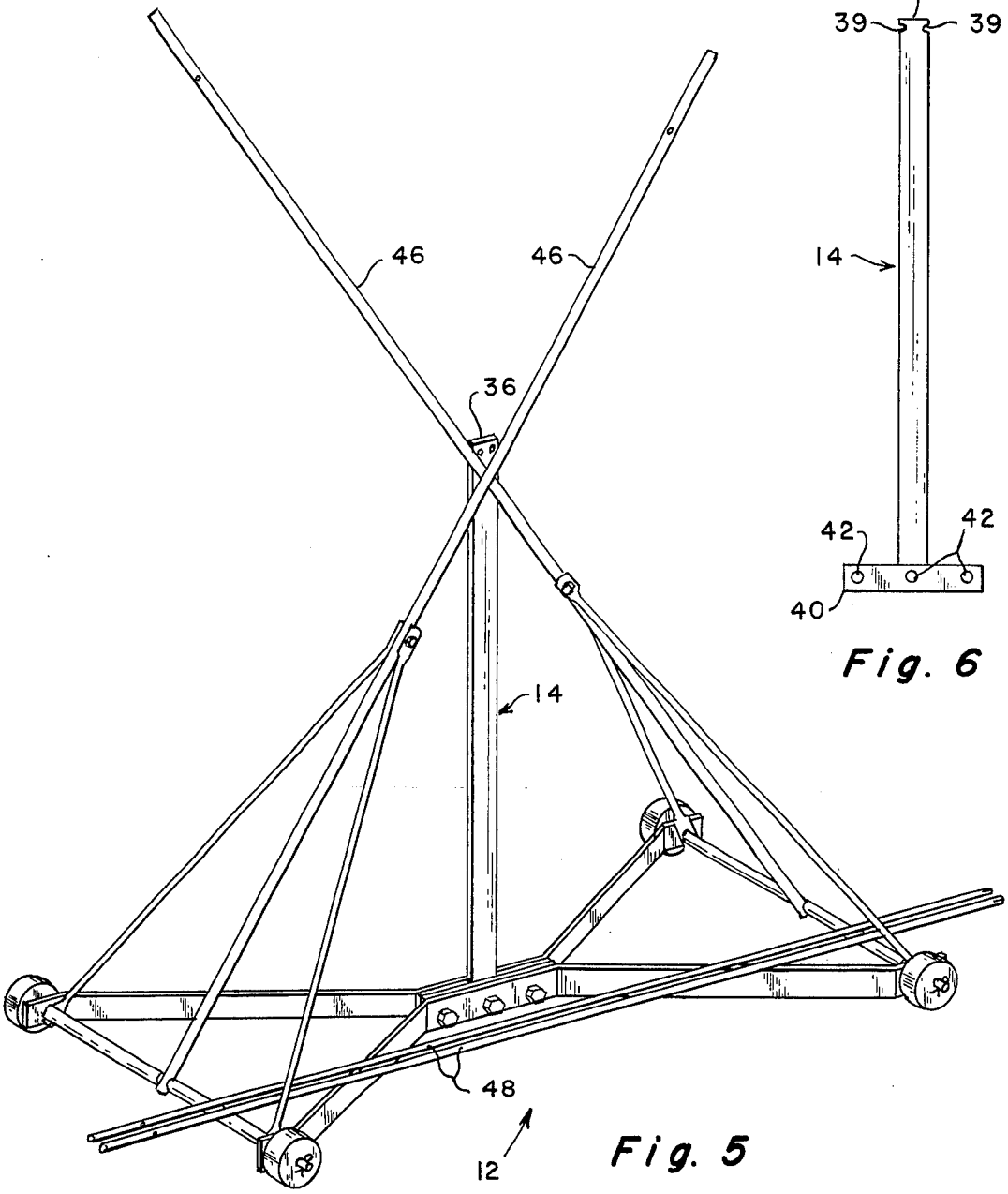
FIG. 5 is a perspective view of the portable support frame of FIG. 1 in a dismantled position for storage or transfer.
FIG. 6 is a side view of the vertical support member of the portable support frame of FIG. 1.

Preferably, as seen in FIG. 6, the vertical support member 14 is in the form of an inverted T. The base 40 of the vertical support member 14 is, as herein embodied, welded in position. Holes 42 are drilled in the base 40 to provide means for attaching the vertical support member 14 to the base 12.

As here embodied and as seen in FIGS. 1, 3 and 4, the base 40 of the vertical support member 14 is sandwiched between the center sections 20 of the two base frame members 18 and the three members are rigidly joined together by means of bolts 44.

In accordance with the invention, a pair of beam means extending from and pivotally attached to the base for supporting the outer, top ends of a rectangular net are provided. As herein embodied, beam support members 16 are pivotally attached to and extend outwardly from the base 12 on each side of the vertical support member 14. The beam support members 16 and the vertical support member 14 are in substantially the same vertical plane.

As herein embodied and as best seen in FIG. 4, each beam support member 16 is pivotally attached for rotation in substantially the same vertical plane to the center of a respective one of the axles 26. Any means of pivotal attachment may be used, however, it is preferred that a hole be provided in the attached end of the vertical support member 16 through which the axle 26 is passed.

Preferably, the beam support members 16 are made of a rigid metal in the form of a pipe or tube. It may be preferred that the beam support members 16 be made of wood or of a rigid plastic. It may be preferred that the beam support members be in the form of an I-beam or other substantially rigid shape in order to provide the necessary strength.

It is also preferred that the beam support member 16 be comprised of two or more detachable sections. As herein embodied, the beam support member 16 is divided into two sections 46 and 48. As best seen in FIG. 3, one section 46 has an inner diameter larger than the outer diameter of the second section 48 so that the second section 48 can be inserted into the first section 46 and held in place by means of a bolt 50. The first section 46 is pivotally attached to the base 12.

It may also be preferred that the beam support member 16 be comprised of two or more hinged sections to permit folding of the beam support member 16.

In accordance with the invention, means for attaching the outer, top ends of a rectangular net to the remote ends of the beam means are provided. When the net is attached to the ends of the beam means, cantilever beams are formed; the cantilever beams and vertical support means are substantially in the same vertical plane. As herein embodied, means are provided on the remote ends of the beam support members 16 for attaching the outer, top ends 41 of the tennis net 38. The means for attaching the tennis net 38 to the beam support members 16 may be any convenient means for tying the end 41 of the tennis net 38 to the ends of the beam support member 16. As seen in FIG. 2, the means provided at the end of the beam support member 16 is a slot 52. It may also be preferred that the means be a hole 55 drilled in the beam support member proximate to its end as in FIG. 3.

Other means for attaching the net to the beam support members are possible. For example, a cylinder having one closed end with an inner diameter slightly larger than the remote end of the beam support member may be attached to the outer, top ends of the tennis net such that the cylinder may be sliped over the end of the beam support member thereby securing the net to the beam.

It may be preferred that weights 53 and 54 be attached to the remote ends 57 of the beam support members 16. This would be particularly necessary where the beam support member 16 was not of sufficient weight to provide the necessary tension to the top of the tennis net 38. Several types of weights may be used, such as, in FIG. 2, a weight 53 slipped over, and secured proximate to, the end 57 of the beam support member 16, or a weight 54 may be suspended from the end 57 of the beam support member 16, as best seen in FIG. 3. It is also possible to provide the weights by incorporating them in the bottom ends 43 of the tennis net 38.

It is preferred that a pair of sleeves 56 be provided to encompass each of the axles 26. As best seen in FIG. 4, one sleeve 56 is placed around the axle 26 on each side of the attached end 58 of the beam support member 16 between the beam support member 16 and the flange 24. The sleeves 56 are provided to restrict any horizontal movement of the beam support members 16 along the axles 26.

It is also preferred and is herein embodied that a pair of sway braces 60 are provided to add additional sway restraint. As best seen in FIG. 4, the sway braces 60 are attached at one end 62 to the beam support members 16. A bolt 64 is passed through holes in the attached end 62 of the sway brace 60 and through a hole provided in the beam support member 16. The other ends of the sway braces 60 are pivotally attached for rotation in a vertical plane to the opposite ends of the respective axles 26 between the sleeve 56 and the flange 24.

It is preferred that the portable support frame of this invention be made of rigid metal such as steel. However, the portable support frame may be made of wood or a rigid plastic. In any event, if used for tennis, the material utilized in the portable support frame must be capable of supporting and providing the necessary tension to a regulation tennis net. In addition, the material of which the beam support members 16 are made must have sufficient weight so that, when the remote end of the beam support member 16 is attached to the upper, outer corners 41 of the tennis net 38 to form cantilever beams, the weight of the beam support member 16 will provide the necessary tension to the top of the tennis net 38. Furthermore, the material of which the vertical support member 16 is made must be able to withstand the tension placed on it and also support the weight of the tennis net 38.

Preferably, the dimensions of the portable support frame are such that, when supporting a tennis net 38 of the regulation 27 feet in width, the outer, upper ends 41 of the tennis net 38 are suspended 3½ feet above the playing surface and the top center 37 of the tennis net 38 is supported 3 feet above the playing surface. It may also be preferred that the portable support frame be of dimensions sufficient to support a 36 foot wide regulation tennis net for doubles.

It is possible to incorporate a means for supporting the 27 foot and 36 foot tennis nets 38 into the same portable support frame. This may be accomplished by adding extensions to the ends of the beam support members 16. Or, the portable support frame may be provided with two different second sections 48 of the beam support member 16, one to be used with a 27 foot net and one to be used with a 36 foot net.

One of the advantages of the portable support frame as herein embodied is that it may be dismantled for storage or transport. As seen in FIG. 5, by removing the second sections 48 of the beam support member 16 and pivoting the first sections 46 of the beam support members 16 toward the vertical support member 14, the portable support frame takes up significantly less space and may be moved and stored with ease.

In operation, the portable support frame is moved into an open space, such as a parking lot or gymnasium in a folded position like that depicted in FIG. 5. The first sections 46 of the beam support member 16 are pivoted away from the vertical support member 14 to extend outwardly from the base 12. The second sections 48 are inserted into the first sections 46 and secured in place by a bolt 50. The tennis net 38 is attached at its top center 37 to the top 36 of the vertical support member 14. The ends 57 of the beam support members 16 are attached to the outer, upper ends 41 of the tennis net 38. After attaching the tennis net 38, the weight of the beam support members 16 provides tension to the top of the tennis net 38. It may be necessary to attach weights 53 and 54 to the ends of the beam support members 16 so that the tennis net 38 is properly taut and the upper, outer ends 41 of the tennis net 38 are 3½ feet from the playing surface.

The portable support frame is designed to provide stability of the tennis net 38 in conditions normally encountered in outdoor tennis. Particularly, wind acting against the tennis net 38 may cause a sway in a horizontal direction. This is practically prevented by means of the sway braces 60 and the sleeves 56. Furthermore, the stability of the tennis net is enhanced by the relatively broad base 12 and the rigidly attached vertical support member 14 in the center.

The invention provides a portable support frame which is easily assembled and disassembled and which provides the stable support means for a tennis net 38 without recourse to attachment to the playing surface.

It will be apparent to those skilled in the art that various modifications could be made in the portable support frame of the invention without departing from the scope or spirit of the invention.

What is claimed is:

1. A portable support frame for a tennis net having its longitudinal axis extending horizontally, comprising:

a. a stable, horizontally disposed base;

b. a vertical support member rigidly attached at one of its ends to said base;

c. means for attaching the top of said tennis net to the remote end of said vertical support member providing support substantially at the center of said net;

d. a pair of beam support members, each of said pair being pivotally attached at one of its ends to said base, said pair of beam support members extending upwardly and outwardly from said base on opposite sides of said vertical support member, said beam and vertical support members being substantially in the same vertical plane; and e. means for attaching the outer, top ends of said tennis net to the remote ends of said beam support members, said beam support members forming cantilever beams when said tennis net is attached thereto.

2. The portable support frame as in claim 1 wherein the base includes two like, integral base frame members each formed of a center section, two side sections extending obliquely from the ends of the center section and at substantially the same angle thereto, and a flange extending from the remote end of each side section and being substantially parallel to the center section, said base frame members being joined back-to-back at their center sections to form the sides and joined apexes of said equilateral triangular frames, and a pair of axles mounted in and between two opposite flanges, the axles being substantially parallel to each other and the ends of the axles extending through the flanges to form the bases of said triangular frames.

3. The portable support frame as in claim 2 also including wheels rotatably attached to each end of both axles.

4. The portable support frame as in claim 2 wherein each of said beam support members is pivotally attached to the center of a respective one of said axles for rotation in substantially the same vertical plane, wherein said vertical support member is rigidly attached to the center sections of said joined base frame members, and wherein said frame includes a pair of sleeves encompassing each of said axles, one on each side of the attached end of said beam support member between said beam support member and said flange.

5. The portable support frame as in claim 4 wherein said vertical support member is formed in the shape of an inverted T with the base sandwiched between the center sections of said base frame members, and wherein said frame includes bolt means for securing said base frame members and said vertical support member together.

6. The portable support frame as in claim 4 also including two pairs of sway restraint braces, the braces of each of said pairs being attached at one end to a respective one of said beam support members, the other ends of each pair of sway restraint braces being pivotally attached for rotation in a vertical plane to the opposite ends of the respective axles between said sleeves and said flanges.

7. A portable support frame as in claim 1 wherein said beam support members are comprised of two or more detachable sections.

8. The portable support frame as in claim 1 wherein said beam support members are comprised of two or more hinged sections for folding said beam support members.

9. A portable frame as in claim 1 wherein said frame is of a material sufficiently strong and rigid to provide support and tension to said tennis net.

10. The portable support frame as in claim 1 also including members for holding the top of said net taut.

11. A game device, comprising:

a. a stable, horizontal base;

b. a rectangular planar net said net being supported on said base in a substantially vertical plane with its longitudinal axis extending substantially horizontal;

c. a vertical support member, one end being rigidly attached to said base and the other end being attached to the top center of said net;

d. a pair of beam support members, each having a first and a second end, said beam support members being pivotally attached at their first ends to opposite sides of said base, said beam support members extending upwardly and outwardly from said base on opposite sides of said vertical support member, the second end of each beam support member being attached to and supporting an outer, top end of said net, said beam support members forming cantilever beams with said net and holding the top edge of said net taut.

12. The game device as in claim 11 wherein its dimensions are such that the top of a rectangular net 27 feet long is supported 3 feet above the playing surface at its center and 3½ feet above the playing surface at its ends.

13. The game device as in claim 11 wherein it dimensions are such that the top of a rectangular net 36 feet long is supported 3 feet above the playing surface at its center and 3½ feet above the playing surface at its ends.

14. A portable support frame for a tennis net, having its longitudinal axis extending substantially horizontal, comprising:

a. a horizontal, stable base frame comprising two like, integral base frame members each formed of a center section, two side sections extending obliquely from the ends of the center section and at substantially the same angle thereto, and a flange extending from the remote end of each side section, being substantially parallel to said center section;

b. a vertical support member having a base forming an inverted T, the base of said vertical support member being sandwiched between said center sections of said base frame members, said base frame members and vertical support member being rigidly joined together;

c. means on the remote end of said vertical support member for attaching the top, center of said tennis net;

d. a pair of axles, each being mounted to and extending between opposing flanges, the ends of said axles projecting through said flanges, said axles being substantially parallel to each other;

e. a wheel secured to each projecting end of each of said axles;

f. a pair of beam support members, one end of each of said beam support members being pivotally attached to the center of a respective one of said axles for allowing pivotal movement of each beam in a vertical plane, said vertical and beam support members being in substantially the same vertical plane;

g. means on the remote ends of said beam support members for attaching the outer, top ends of said tennis net, said beams forming cantilever with said tennis net and holding the top edge of said tennis net taut;

h. a pair of sleeves encompassing each of said axles, one of said sleeves being on each side of the attached end of each beam support member and between said beam support member and one of said flanges; and i. two pairs of sway restraint braces, the braces of each pair of which being attached at one end to a respective one of said beam support members, the other ends of each pair of sway restraint braces being pivotally attached to the opposite ends of the respective axles between said sleeves and said flanges for allowing pivotal movement of each brace in a vertical plane.

15. The portable support frame as in claim 14 wherein said support members are comprised of two or more detachable sections.

16. The portable support frame as in claim 14 also including weights attached to the remote ends of said beam support members.

17. The portable support frame as in claim 14 wherein the frame is dimensional to support said tennis net in accordance with the dimensional requirements of regulation tennis.

* * * * *

UNITED STATES PATENT AND TRADEMARK OFFICE

CERTIFICATE OF CORRECTION

PATENT NO. : 4,010,951

DATED : March 8, 1977

INVENTOR(S) : Thomas R. Gronlund

It is certified that error appears in the above-identified patent and that said Letters Patent are hereby corrected as shown below:

Column 8, line 8, after "portable", insert ---support---.

Column 8, line 37, change "it" to ---its---.

Column 10, line 10, after "said", insert ---beam---.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*